US010739022B2

(12) United States Patent
Jeon et al.

(10) Patent No.: US 10,739,022 B2
(45) Date of Patent: Aug. 11, 2020

(54) BATHROOM MANAGEMENT APPARATUS

(71) Applicant: LG ELECTRONICS INC., Seoul (KR)

(72) Inventors: Jinhyeon Jeon, Seoul (KR); Daeyun Park, Seoul (KR); Inhyung Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 292 days.

(21) Appl. No.: 15/833,048

(22) Filed: Dec. 6, 2017

(65) Prior Publication Data

US 2018/0156477 A1 Jun. 7, 2018

(30) Foreign Application Priority Data

Dec. 6, 2016 (KR) ..... 10-2016-0165288

(51) Int. Cl.

| | |
|---|---|
| ***F24F 3/153*** | (2006.01) |
| ***F24F 13/06*** | (2006.01) |
| ***F24F 13/02*** | (2006.01) |
| ***E03D 9/04*** | (2006.01) |
| ***F24F 1/022*** | (2019.01) |
| *F24F 13/20* | (2006.01) |

(Continued)

(52) U.S. Cl.

CPC ..... *F24F 3/153* (2013.01); *F24F 1/022* (2013.01); *F24F 13/0272* (2013.01); *F24F 13/0604* (2013.01); *E03D 9/04* (2013.01); *F24F 3/1603* (2013.01); *F24F 5/0096* (2013.01); *F24F 13/02* (2013.01); *F24F 13/20* (2013.01); *F24F 2003/144* (2013.01); *F24F 2221/02* (2013.01); *F24F 2221/10* (2013.01)

(58) Field of Classification Search

CPC ..... F24F 1/022; F24F 3/153; F24F 13/0272; F24F 13/0604; E03D 9/04

USPC ..... 219/218, 219

See application file for complete search history.

(56) References Cited

U.S. PATENT DOCUMENTS 1,918,047 A * 7/1933 Marchand ..... A47B 67/005 362/129

3,521,936 A * 7/1970 Coker, Jr. ..... A47B 67/02 312/209

(Continued)

FOREIGN PATENT DOCUMENTS

CN 203539188 4/2014

OTHER PUBLICATIONS

Chinese Office Action dated Jan. 13, 2020 issued in CN Application No. 201711275530.7.

*Primary Examiner* — Vishal Pancholi

(74) *Attorney, Agent, or Firm* — KED & Associates, LLP

(57) ABSTRACT

A bathroom management apparatus is provided which has a storage cabinet and an integrated air conditioning, or dryer, module. The bathroom management apparatus includes: a cabinet forming an interior space whose front is open; a first dividing plate provided within the cabinet and dividing the interior space; a second dividing plate provided within the cabinet in parallel with the first dividing plate and dividing the interior space, and forming a storage chamber in the space between the first and second dividing plates; a duct connected to the first dividing plate and the second dividing plate, provided within the cabinet, and dividing the storage chamber; and the air conditioning module installed within the duct.

20 Claims, 16 Drawing Sheets

(51) Int. Cl.

| | |
|---|---|
| *F24F 3/14* | (2006.01) |
| *F24F 5/00* | (2006.01) |
| *F24F 3/16* | (2006.01) |

(56) References Cited

U.S. PATENT DOCUMENTS

| | | | | | |
|---|---|---|---|---|---|
| 3,732,702 | A * | 5/1973 | Desch | A47B 67/005 | 62/3.6 |
| 4,701,594 | A * | 10/1987 | Powell | A45D 20/16 | 219/203 |
| 4,753,496 | A * | 6/1988 | Bussard | F24F 7/065 | 312/116 |
| 5,063,283 | A * | 11/1991 | Orazi | A47G 1/02 | 219/218 |
| 5,355,627 | A * | 10/1994 | Katz | A47B 81/00 | 312/227 |
| 6,365,876 | B1 * | 4/2002 | Park | A47G 1/02 | 219/219 |
| 8,166,667 | B1 * | 5/2012 | Lora | F26B 9/003 | 34/202 |
| 2003/0042828 | A1 * | 3/2003 | Bonin | A47B 67/02 | 312/245 |
| 2014/0145578 | A1 * | 5/2014 | Trecco | F16C 29/001 | 312/334.1 |

* cited by examiner

BATHROOM MANAGEMENT APPARATUS

CROSS-REFERENCE TO RELATED APPLICATION

This application claims priority under 35 U.S.C. § 119 to Korean Application No. 10-2016-0165288 filed on Dec. 6, 2016, whose entire disclosure is hereby incorporated by reference.

BACKGROUND

1. Field

The present disclosure relates to a bathroom management apparatus, and more particularly, to a bathroom management apparatus that has a storage cabinet and an air conditioning module integrated together.

2. Background

Bathrooms are rooms in homes for personal hygiene activities and may include, for example, a sink (or basin), a bathtub and/or a shower, and the toilet. A bathroom is generally the most humid place in the home and, therefore, is susceptible to a growth of mold, germs, and bacteria and to the resulting odors.

Most bathrooms may be dried and deodorized using an exhaust fan. However, the exhaust fan may not work properly or may be insufficient, by itself, to keep the entire bathroom dry. Any remaining moisture may permit mold and bacteria to thrive, causing undesirable contamination in the bathroom. Thus, it is desirable to remove moisture from the bathroom floor and walls and to dry wet bathroom items, such as towels hanging on towel bars or rings in the bathroom, as quickly as possible in order to prevent mold and bacteria growth.

Bathrooms may have a storage cabinet (also referred to as a medicine cabinet or vanity) on a wall to store towels or other bathroom items. However, installing an air conditioning or dryer module for drying the bathroom may be subject to space limitations since the bathroom may include various fixtures, including a sink, a toilet, and a towel bar, as well as the storage cabinet.

BRIEF DESCRIPTION OF THE DRAWINGS

The embodiments will be described in detail with reference to the following drawings in which like reference numerals refer to like elements, and wherein.

DETAILED DESCRIPTION

Figure 1:
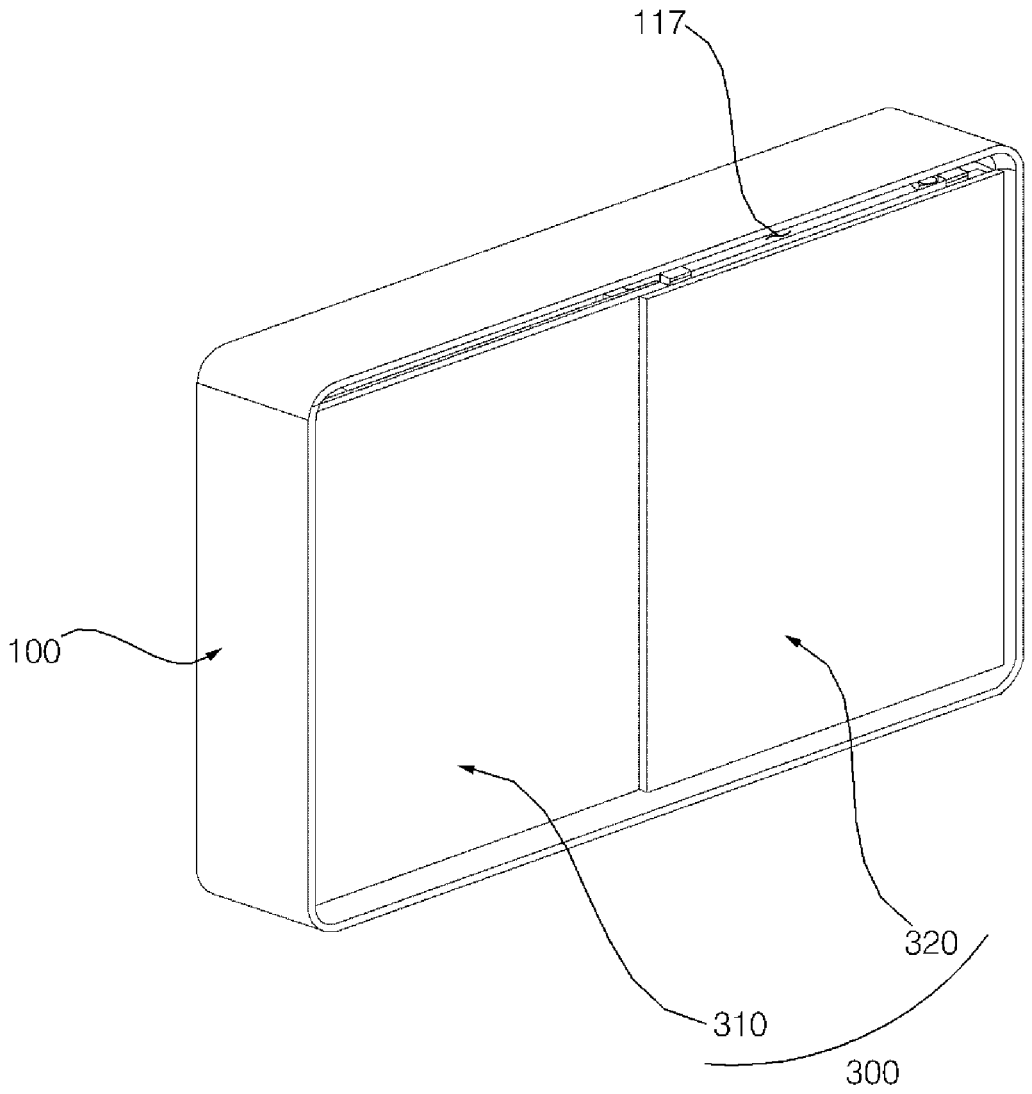
FIG. 1 is an assembled perspective view of a bathroom management apparatus according to a first exemplary embodiment of the present disclosure.

Hereinafter, a bathroom management apparatus (or cabinet) according to embodiments of the present disclosure will be described with reference to the accompanying drawings.

Referring to FIGS. 1 to 4, the bathroom management apparatus according to the first exemplary embodiment of the present disclosure may include a cabinet 100 forming an interior space whose front is open, a first dividing plate 410 provided within the cabinet 100 and dividing the interior space, a second dividing plate 420 provided within the cabinet 100 in parallel with the first dividing plate 410, dividing the interior space, and forming a storage chamber S1 and S2 between it and the first dividing plate 410, a duct 430 connected to the first dividing plate 410 and the second dividing plate 420, provided within the cabinet, and dividing the storage chamber S1 and S2, and an air conditioning module (or dryer) 200 installed within the duct 430. Accordingly, the storage chamber S1 and S2 can be used as a storage cabinet for storing towels and other bathroom items, and the inside of the bathroom can be dried by the air conditioning module 200.

The cabinet 100 may form an interior space whose front may be opened for access by a user. The cabinet 100 may be in the shape of a rectangle with a top portion (or surface), a bottom portion (or surface), and left and right portions (or surfaces), whereby these directions as described relative to a user positioned in front of the bathroom management apparatus installed on a wall of a bathroom. Likewise, the interior space of the cabinet 100 may be in the shape of a rectangle.

The cabinet 100 may include a front cabinet 110 and a rear cabinet 120. The front cabinet 110 may be in the shape of a rectangle whose front and rear may be open. The front cabinet 110 may include a top portion 111 forming the top side, a left portion 112 forming the left side, a right portion 113 forming the right side, and a bottom portion 114 forming the bottom side. The top portion 111, left portion 112, right portion 113, and bottom portion 114 may be substantially planar to be and may be made flat and straight. In the front cabinet 110, each of the corner between the top portion 111 and the left portion 112, the corner between the top portion 111 and the right portion 113, the corner between the bottom portion 114 and the left portion 112, and the corner between the bottom portion 114 and the right portion 113 may be curved.

The rear cabinet 120 may include a rectangular rear portion 121, a top portion 122 protruding forward from the top of the rear portion 121, a left portion 123 protruding forward from the left of the rear portion 121, and a right portion 124 protruding forward from the right of the rear portion 121. The rear portion 121, top portion 122, left portion 123, and right portion 124 may be substantially planar to be and may be made flat and straight. In the rear cabinet 120, each of the corner between the top portion 122 and the left portion 123, the corner between the top portion 122 and the right portion 124, and the bottom facing the top portion 122 may be open.

The front cabinet 110 may be inserted into the rear cabinet 120 from the front of the rear cabinet 120 and may be attached to the rear cabinet 120. That is, the top portion 122 of the rear cabinet 120 may be attached onto the top portion 111 of the front cabinet 110, the left portion 123 of the rear cabinet 120 may be attached to the left of the left portion 112 of the front cabinet 110, and the right portion 124 of the rear cabinet 120 may be attached to the right of the right portion 113 of the front cabinet 110. In this manner, when the front cabinet 110 and the rear cabinet 120 are attached, the corner between the top portion 111 and left portion 112 of the front cabinet 110 may block off the open corner between the top portion 122 and left portion 123 of the rear cabinet 120, and the corner between the top portion 111 and right portion 113 of the front cabinet 110 may block off the open corner between the top portion 122 and right portion 124 of the rear cabinet 120. Also, the open bottom of the rear cabinet 120 may be blocked off by the bottom portion 114 of the front cabinet 110, the corner between the bottom portion 114 and left portion 112 of the front cabinet 110, and the corner between the bottom portion 114 and right portion 113 of the front cabinet 110.

In this way, the top portion 111 of the front cabinet 110 and the top portion 122 of the rear cabinet 120 may form the top portion of the cabinet 100, and the left portion 112 of the front cabinet 110 and the left portion 123 of the rear cabinet 120 may form the left portion of the cabinet 100. Similarly, the right portion 113 of the front cabinet 110 and the right portion 124 of the rear cabinet 120 may form the right portion of the cabinet 100, and the bottom portion 114 of the front cabinet 110 may form the bottom portion of the cabinet 100. Furthermore, the corner between the top portion 111 and left portion 112 of the front cabinet 110 may form the corner between the top portion and left portion of the cabinet 100, the corner between the top portion 111 and right portion 113 of the front cabinet 110 may form the corner between the top portion and right portion of the cabinet 100, the corner between the bottom portion 114 and left portion 112 of the front cabinet 110 may form the corner between the bottom portion and left portion of the cabinet 100, and the corner between the bottom portion 114 and right portion 113 of the front cabinet 110 may form the corner between the bottom portion and right portion of the cabinet 100. The rear portion 121 of the rear cabinet 120 may form the rear portion of the cabinet 100.

A first dividing plate 410, a second dividing plate 420, and a duct 430 are provided in the interior space in the cabinet 100. The first dividing plate 410 may be provided between the top portion of the cabinet 100 and the second dividing plate 420 and connected to the left portion and right portion of the cabinet 100, and divides the interior space of the cabinet 100 into upper and lower sections. The first dividing plate 410 may be located immediately below the top portion of the cabinet 100, spaced apart from the top portion of the cabinet 100, and runs laterally. The left edge of the first dividing plate 410 may be attached to the left portion of the cabinet 100, and the right edge may be attached to the right portion of the cabinet 100.

The second dividing plate 420 may be provided between the bottom portion of the cabinet 100 and the first dividing plate 410 and connected to the left portion and right portion of the cabinet 100, and divides the interior space of the cabinet 100 into upper and lower sections. The second dividing plate 420 may be provided in parallel with the first dividing plate 410. The second dividing plate 420 may be located immediately above the bottom portion of the cabinet 100, spaced apart from the bottom portion of the cabinet 100, and runs laterally. The left edge of the second dividing plate 420 may be attached to the left portion of the cabinet 100, and the right edge may be attached to the right portion of the cabinet 100.

The first dividing plate 410 and the second dividing plate 420 may be vertically spaced apart from each other and may be provided in the interior space of the cabinet 100. Storage chambers S1 and S2 may be formed in the space between the first dividing plate 410 and the second dividing plate 420. The user may store towels or other bathroom items in the storage chambers S1 and S2.

The duct 430 may be connected to the first dividing plate 410 and the second dividing plate 420 and may separate the storage chambers S1 and S2, respectively, into left and right sections. The duct 430 may be in a T shape, so a top portion has a larger horizontal length than other portions of the duct 430. The duct 430 may be provided in the middle between the left and right sections of the interior space of the cabinet 100, and may divide the storage chambers S1 and S2 equally and symmetrically into left and right sections. The door 300 may slide in a lateral direction to open and/or close the storage chambers S1 and S2.

The door 300 may include a first door 310 and a second door 320. When either the first door 310 or the second door 320 is fully open (e.g., slid to expose storage chambers S1 or S2), the first door 310 and the second door 320 block the duct 430 from the front. That is, a part of the interior space of the cabinet 100 where the duct 430 is installed may be a "dead" zone which be accessed when doors 310 and/or 320 are open and cannot be used as the storage chambers S1 and S2 when the door 300 is open. Since the duct 430 may be installed in the dead zone, the amount of space that can be used as the storage chambers S1 and S2 in the interior space of the cabinet 100 may be maximized.

The front and left and right sides of the duct 430 may be blocked and the rear may be open. The open rear of the duct 430 may be covered by the rear portion of the cabinet 100. Thus, an empty space may be provided between the duct 430 and the rear portion of the cabinet 100, and air may flow in this empty space. Hereinafter, the inside of the duct 430 may be refer to the empty space which exists between the duct 430 and the rear portion of the cabinet 100.

The air conditioning module (also referred to as a dryer module or dryer) 200 may be installed within the duct 430. The air conditioning module 200 may include a case 210 forming the external appearance of the air conditioning module 200, a blast fan 220 installed within the case 210, and a heater 230 installed within the case 210. A fan motor 240 for driving the blast fan 220 may be installed in the case 210. The blast fan 220 may be provided to run laterally and to be installed within the duct 430, and the fan motor 240 may be attached to the case 210. A rotating shaft of the fan motor 240 may be attached to one longitudinal end of the blast fan 220 and may rotate the blast fan 220. The heater 230 may be implemented as an electric heater that converts electric energy into heat energy when supplied with electricity, thereby heating and drying the air in the duct 430.

An air inlet 115 for letting air into the duct 430 may be formed in the bottom portion of the cabinet 100, and the space between the top portion of the cabinet 100 and the first dividing plate 410 may form an air outlet 117 for releasing air out of the duct 430. When the door 300 is closed, the air outlet 117 may release air from the duct 430 toward the front through a gap between the top portion of the cabinet 100 and the top of the door 300.

When the blast fan 220 is driven, the air in the bathroom may be introduced into the duct 430 through the air inlet 115 by the suction force of the blast fan 220, and then the air (after being heated, dried, etc., may be released to the front through the air outlet 117 and discharged into the bathroom. The inside of the bathroom may be dried by the air discharged through the air outlet 117, and the user's body may be dried too if the user directs the air discharged through the air outlet 117 towards themselves (e.g., after a shower).

The blast fan 220 may be installed below the heater 230, and the heater 230 may be installed above the blast fan 220. When the blast fan 220 and the heater 230 are driven, the air introduced into the duct 430 by the suction force of the blast fan 220 may be warmed by the heater 230 and the warmed air may be then discharged into the bathroom through the air outlet 117. If the heater 230 is installed below the blast fan 220, the air introduced into the duct 430 through the air inlet 115 may be warmed by the heater 230 and then passed through the blast fan 220. In this configuration, the blast fan 220 may be heated and deformed by the warm air and/or radiant heat raising from the heater 230. However, in the previously described exemplary embodiment in which the heater 230 is installed above the blast fan 220 and close to the air outlet 117, the blast fan 220 may be not be heated and deformed by the warm air.

A first communicating hole 411 may be formed in the first dividing plate 410 to communicate within the air outlet 117 and the duct 430, and a second communicating hole 421 may be formed in the second dividing plate 420 to communicate within the air inlet 115 and the duct 430.

Moreover, a shield plate 440 may be connected to the bottom portion of the cabinet 100 and the second dividing plate 420. The shield plate 440 may be provided further forward than the air inlet 115 and the second communicating hole 421. The top end of the shield plate 440 may be attached to the second dividing plate 420, and the bottom end may be attached to the lower portion of the cabinet 100. In the space between the air inlet 115 and the second communicating hole 421, the front portion may be blocked by the shield plate 440, the rear portion may be blocked by the rear portion of the cabinet 100, the left portion may be blocked by the left portion of the cabinet 100, and the right portion may be blocked by the right portion of the cabinet 100. Thus, when the blast fan 220 is driven, the air in the bathroom may be introduced into the space between the air inlet 115 and the second communicating hole 421 through the air inlet 115 and then into the duct 430 through the second communicating hole 421, and the air introduced into the duct 430 may pass through the blast fan 220 and the heater 230 and may be then released to the air outlet 117 through the first communicating hole 411.

A filter 116 may be installed in the bottom portion of the cabinet 100. The filter 116 may be installed in the air inlet 115 to remove odors, dust, and bacteria from the air introduced into the air inlet 115 from the bathroom. The filter 116 may be implemented as an antimicrobial filter including a photocatalytic coating layer that is activated by light generated by a second lighting device 520, to be described later.

The first storage chamber S1 may be provided on the left side of the duct 430, and the second storage chamber S2 may be provided on the right side of the duct 430. At least one of the first and second storage chambers S1 and S2 may be divided into multiple sections by storage chamber plates 610 and 620. In this exemplary embodiment, the first storage chamber S1 and the second storage chamber S2 each may be divided into multiple sections by the storage chamber plates 610 and/or 620. The storage chamber plates 610 and 620 may include a horizontal dividing plate 610 dividing the storage chambers S1 and S2 into upper and lower sections and a vertical dividing plate 620 dividing the storage chambers S1 an S2 into left and right sections. The first storage chamber S1 and the second storage chamber S2 may be divided into sections of various sizes by the horizontal dividing plate 610 and the vertical dividing plate 620.

One or more of a sterilization module (or sterilizer) 710 and a refrigeration module (or refrigerator) 720 may be installed in the storage chambers S1 and S2. The sterilization module 710 and the refrigeration module 720 may be selectively included based on a user option when buying the bathroom management apparatus according to the exemplary embodiment of the present disclosure, and none of which may be installed in the storage chambers S1 and S2, or only one of the sterilization module 710 or the refrigeration module 720 may be installed. Moreover, the number of sterilization modules 710 or refrigeration modules 720 to be installed in the storage chambers S1 and/or S2 may vary (e.g., the storage chambers S1 and S2 may include multiple sterilization modules 710 or refrigeration modules 720). In one exemplary embodiment, one sterilization module 710 may be installed in the first storage chamber S1 and used for sterilizing toothbrushes or other personal items, and two refrigeration modules 720 may be installed in the first storage chamber S1, one for refrigerating cosmetics and the other for storing and cooling other bathroom items.

The sterilization module 710 and the refrigeration module 720 may each include a main body 711 forming a storage space whose front may be open, and a door 712 attached to the front of the main body 711 for opening or closing the storage space. An ionizer 713 that emits ions and sterilizes the inside of the storage space may be installed within the sterilization module 710. Moreover, a lighting device 714 that generates light when the door 712 is open may be installed within the sterilization module 710 and the refrigeration module 720. The lighting device 714 may include a light source that generates light and a case containing the light source, and the light source may be implemented as a light-emitting diode LED.

A heat transfer module (or heater transfer) 810 that feeds cold air into the refrigeration module 720 and hot air to the outside of the refrigeration module 720 may be installed within the duct 430. Since the heat transfer module 810 may be installed within the duct 430, the hot air fed to the outside of the refrigeration module 720 may be introduced into the duct 430. Thus, when the blast fan 220 is driven, the hot air from the heat transfer module 810 may be discharged into the bathroom through the air outlet 117. Hereinafter, the sterilization module 710 and the refrigeration module 720 will be referred to as a module 700.

Moreover, a power supply 820 for converting electric power may be installed within the duct 430. The power supply 820 may convert commercial power into power for running the blast fan 220, the heater 230, the module 700, and lighting equipment 510, 520, 530, and 540, and supply the power to the fan motor 240, heater 230, module 700, and lighting equipment 510, 520, 530, and 540. The power supply 820 may emit light during the process of converting electric power. Since the power supply 820 may be installed within the duct 430, when the blast fan 220 is driven, the heat emitted from the power supply 820 may be discharged into the bathroom through the air outlet 117.

The heat transfer module 810 and the power supply 820 may be installed lower than the air conditioning module 200 and within the duct 430, and the power supply 820 may be provided between the air conditioning module 200 and the heat transfer module 810. That is, the air conditioning module 200 may be located in the upper part of the duct 430, the power supply 820 may be located lower than the air conditioning module 200, and the heat transfer module 810 may be located lower than the power supply 820.

The door 300 may be slidably installed on the first dividing plate 410 and the second dividing plate 420 and may open or close the first storage chamber S1 and the second storage chamber S2. The door 300 may slide in a lateral direction to open and close the first storage chamber S1 and the second storage chamber S2.

The door 300 may include a first door 310 for opening and closing the first storage chamber S1 and a second door 320 for opening and closing the second storage chamber S2. The first door 310 and the second door 320 may be installed in such a way as to partially overlap in the front-back direction. A mirror 311 may be provided on the front of the door 300. The mirror 311 may be used in place of a bathroom mirror installed on the wall surface of the bathroom.

The door 300 may be inserted into the open interior space of the cabinet 100 from the front of the cabinet 100 and may partially block the open interior space of the cabinet 100 when closed. The door 300 may be placed within the edge of the open front of the cabinet 100, and may be spaced a distance apart from the edge. That is, the door 300 may be inserted into the open interior space of the cabinet 100, with the top being placed a distance below the top portion of the cabinet 100, the bottom being placed a distance above the bottom portion of the cabinet 100, the left being placed a distance to the right from the left portion of the cabinet 100, and the right being placed a distance to the left from the right portion of the cabinet 100. Thus, gaps may be formed between the top portion of the cabinet 100 and the top of the door 300, a between the bottom portion of the cabinet 100 and the bottom of the door 300, between the left portion of the cabinet 100 and the left of the door 300, and between the right portion of the cabinet 100 and the right of the door 300. Preferably, the top of the door 300 may be placed a distance below the top portion of the cabinet 100, with the air inlet 115 being open, so that the air discharged from the duct 430 may be released to the front through the space between the top portion of the cabinet 100 and the top of the door 300.

The first door 310 and the second door 320 may slide in a lateral direction within the edge of the open front of the cabinet 100 to open and close one or more of the storage chambers S1 and S2. In one example, first door 310 and the second door 320 may slide in opposite lateral directions.

Figure 2:
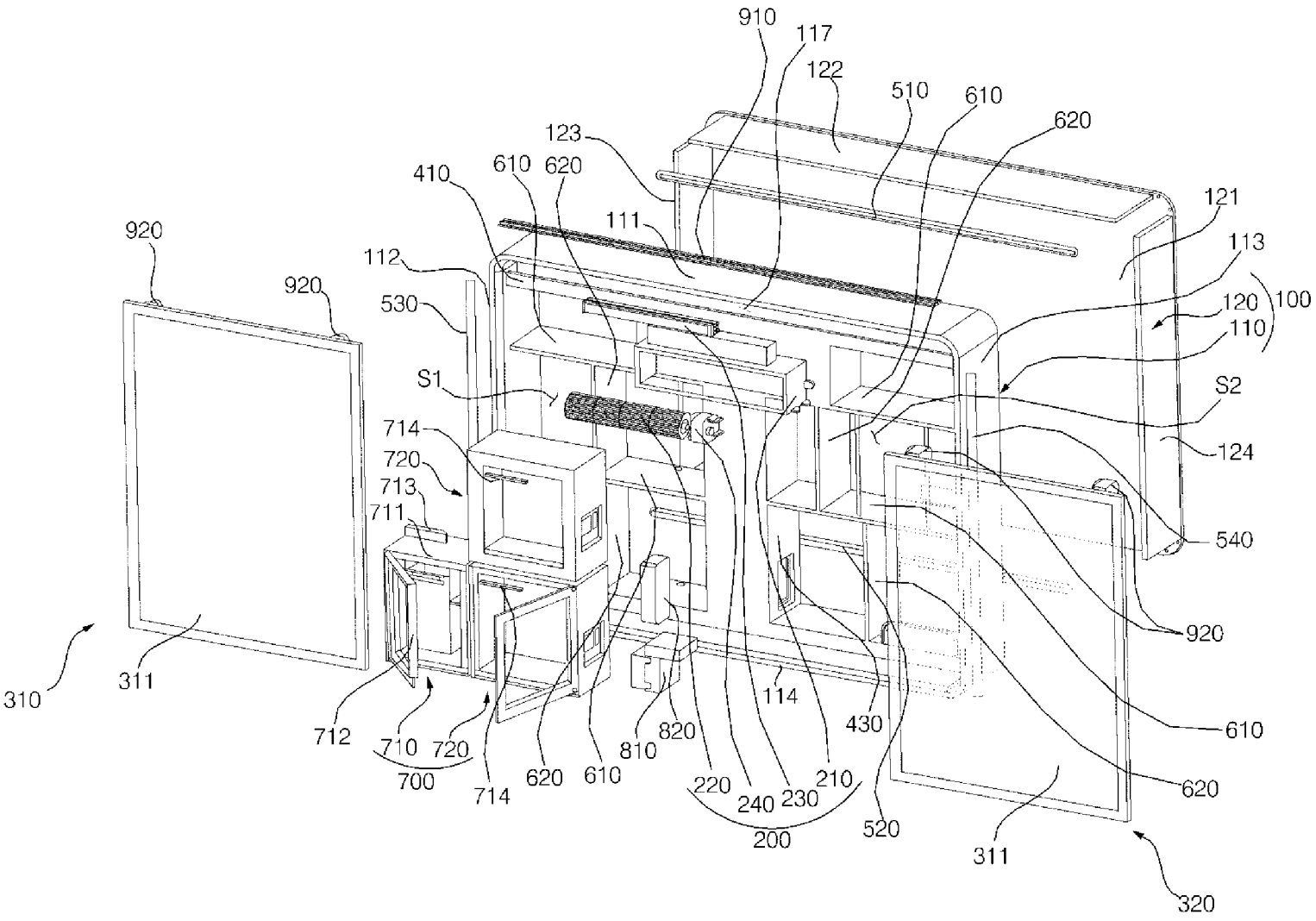
FIG. 2 is an exploded perspective view of the bathroom management apparatus according to the first exemplary embodiment of the present disclosure.
Figure 3:
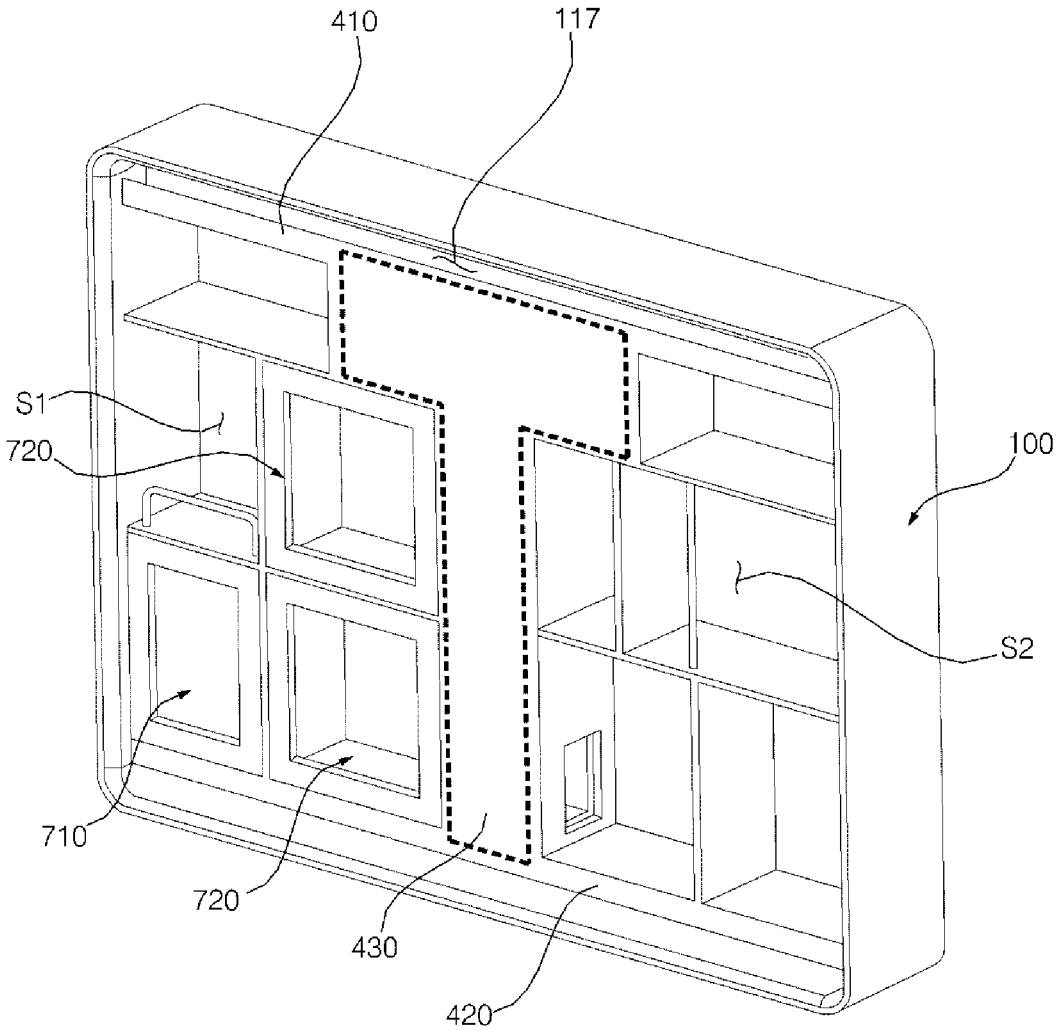
FIG. 3 is a view of a sterilization module and a refrigeration module installed in a cabinet for the bathroom management apparatus according to the first exemplary embodiment of the present disclosure.
Figure 4:
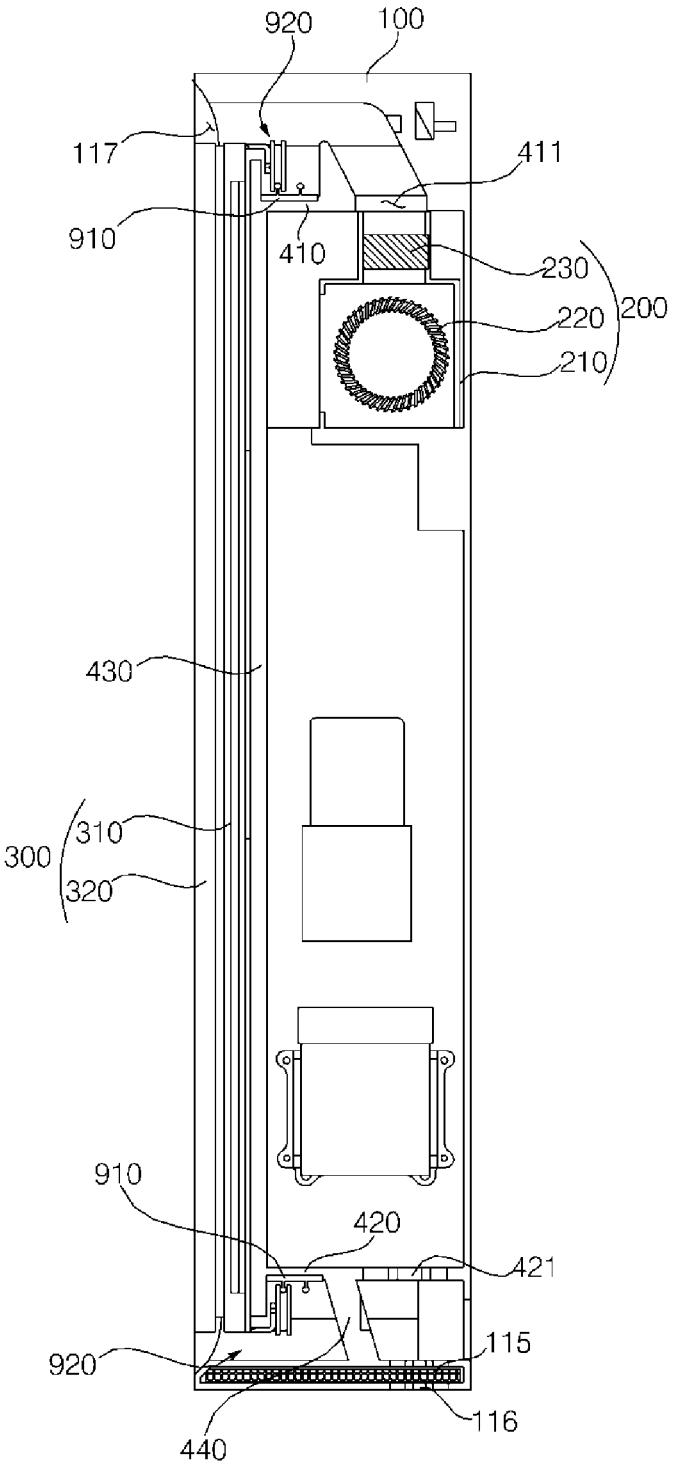
FIG. 4 is a sectional side view of the bathroom management apparatus according to the first exemplary embodiment of the present disclosure.
Figure 5:
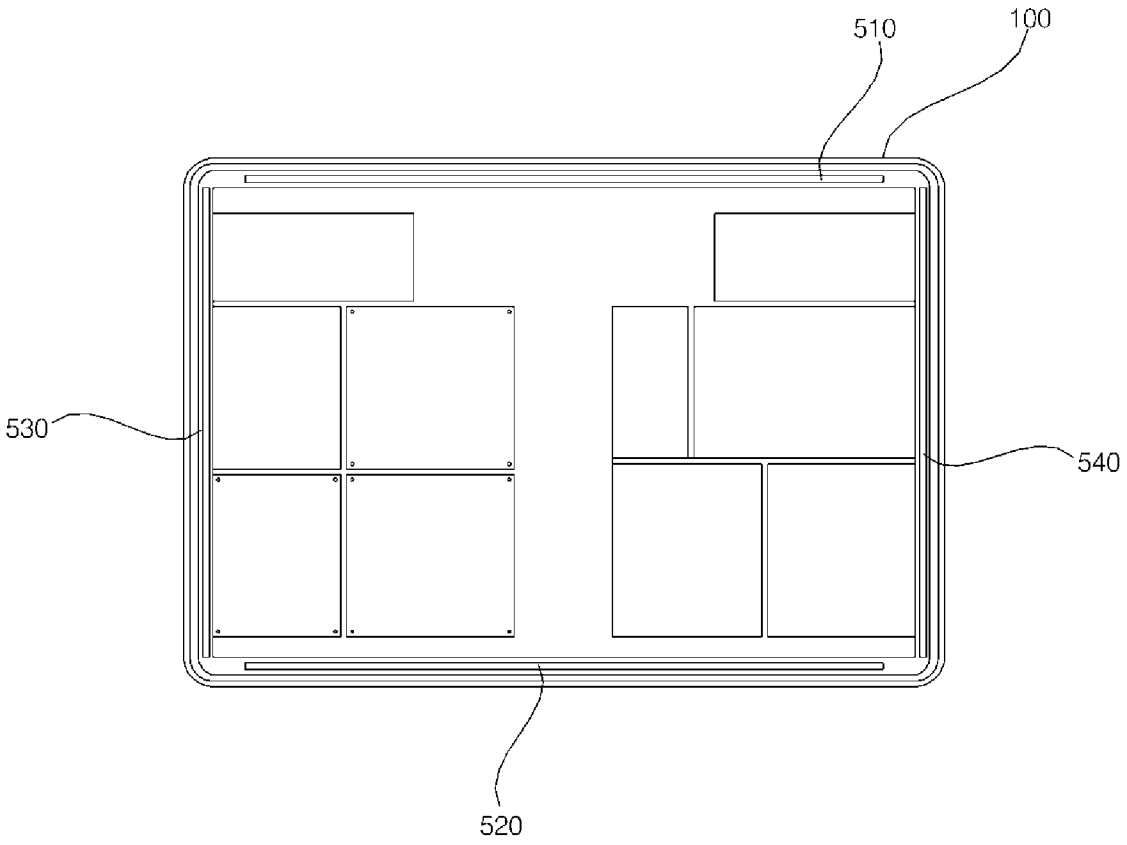
FIG. 5 is a view of lighting equipment installed on the bathroom management apparatus according to the first exemplary embodiment of the present disclosure.
Figure 6:
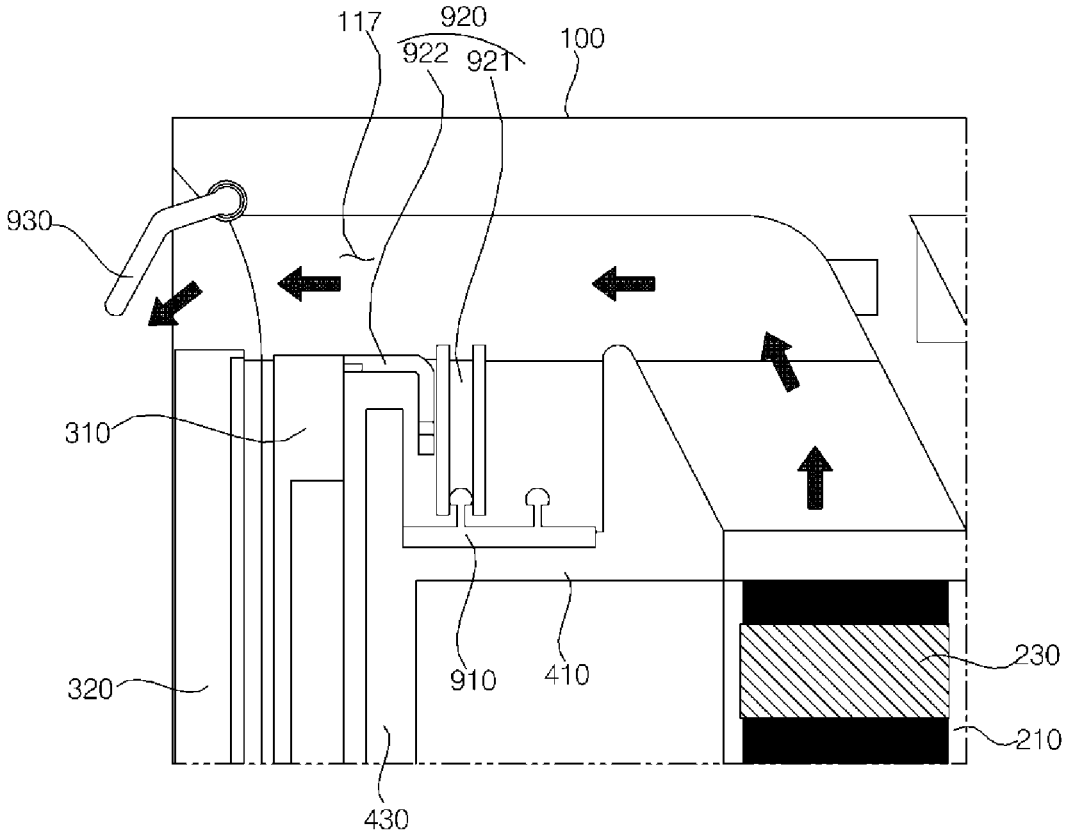
FIG. 6 is a view of an outlet vane when opened in first open mode, in the bathroom management apparatus according to the first exemplary embodiment of the present disclosure.
Figure 7:
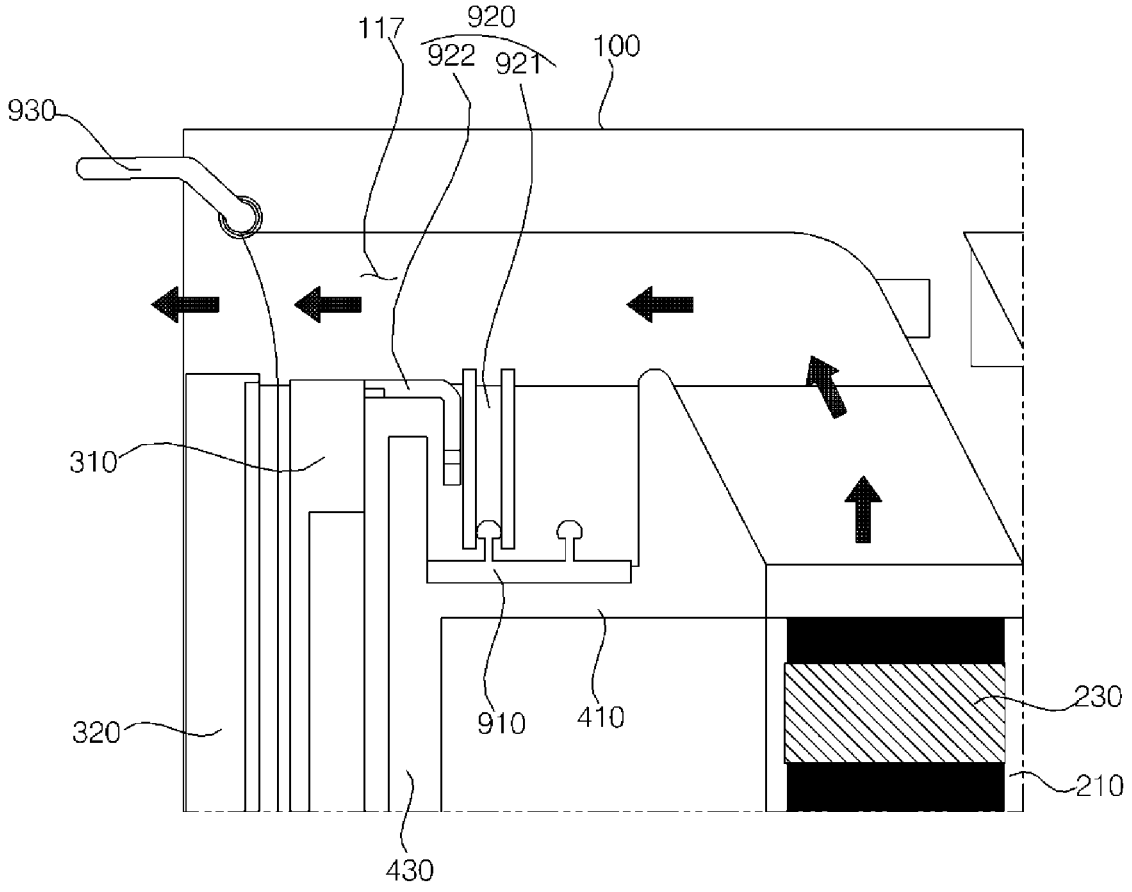
FIG. 7 is a view of the outlet vane when opened in second open mode, in the bathroom management apparatus according to the first exemplary embodiment of the present disclosure.
Figure 8:
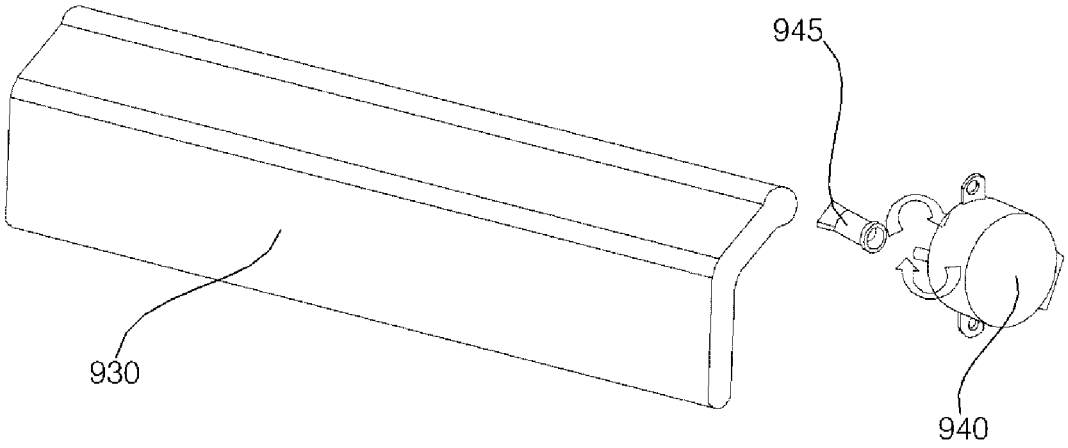
FIG. 8 is a perspective view of the outlet vane and an outlet vane motor in the bathroom management apparatus according to the first exemplary embodiment of the present disclosure.
Figure 9:
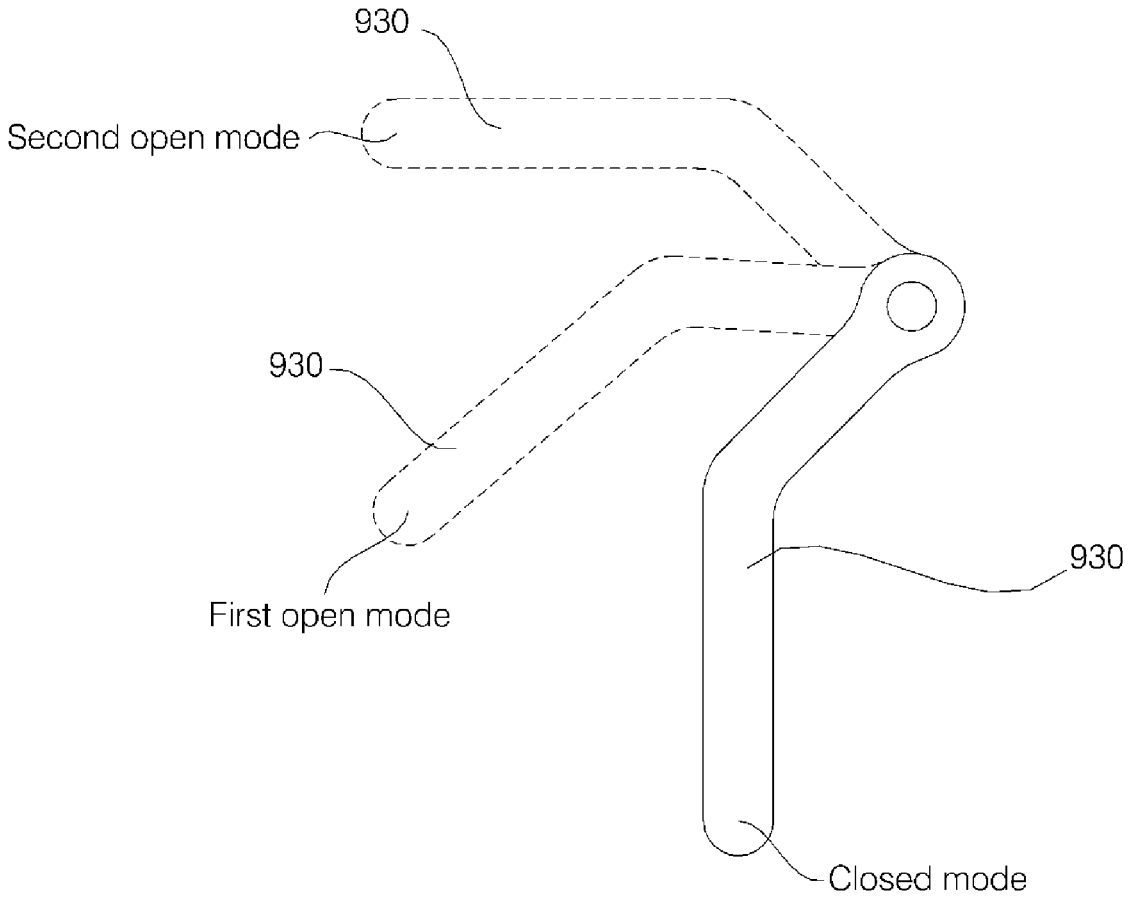
FIG. 9 is a view of the outlet vane's different positions for different modes, in the bathroom management apparatus according to the first exemplary embodiment of the present disclosure.
Figure 10:
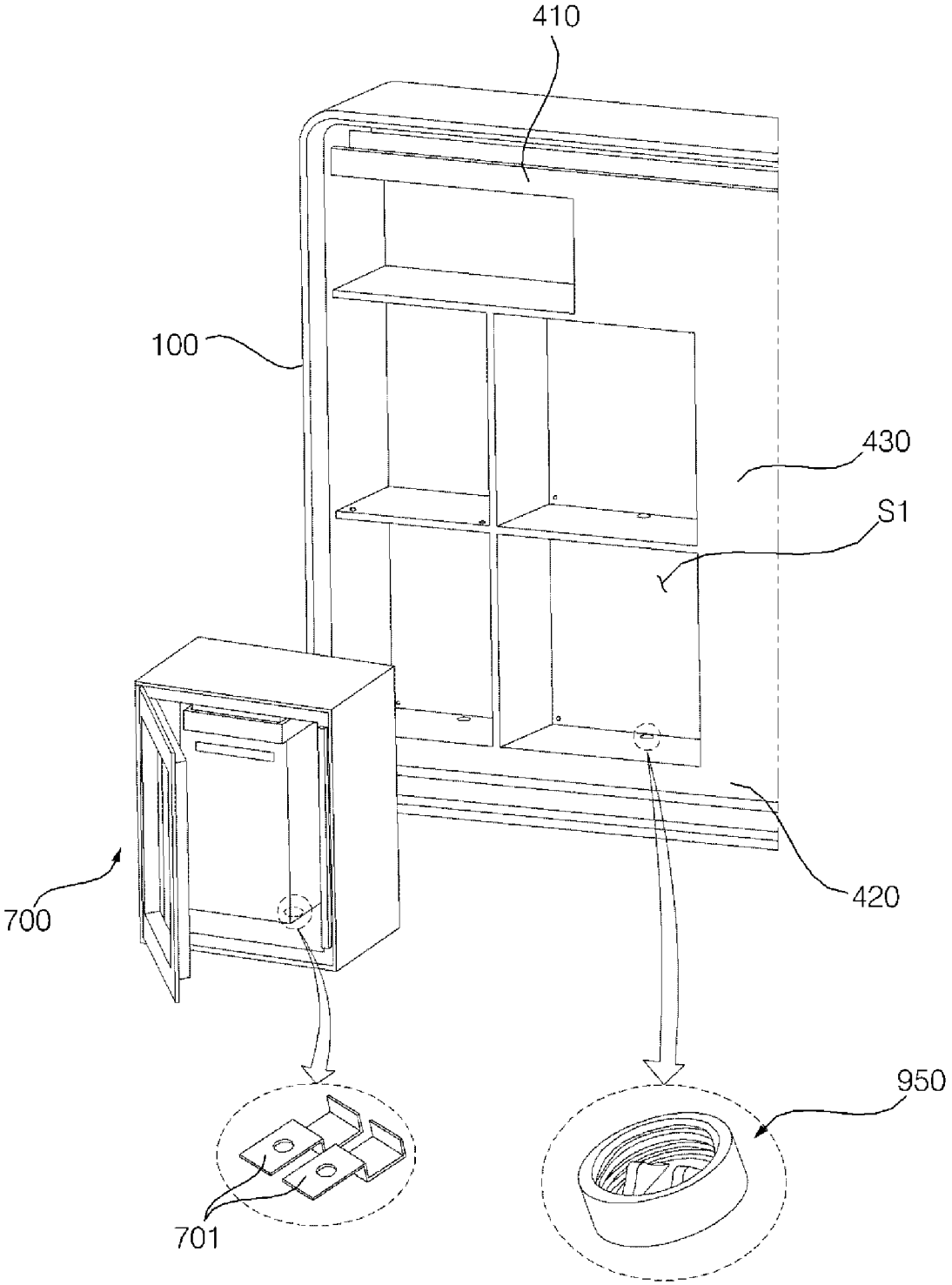
FIG. 10 is a view of a power contact unit that feeds power to a module installed on the bathroom management apparatus according to the first exemplary embodiment of the present disclosure.
Figure 11:
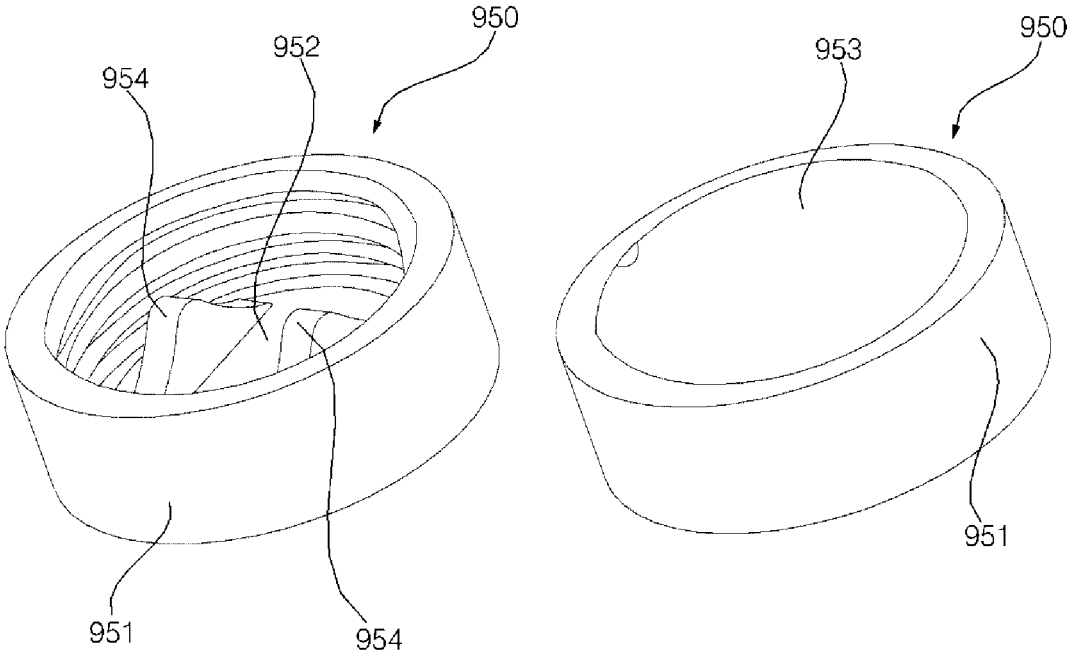
FIG. 11 is a view of a cover attached to the power contact unit when there is no module installed on the bathroom management apparatus according to the first exemplary embodiment of the present disclosure.
Figure 12:
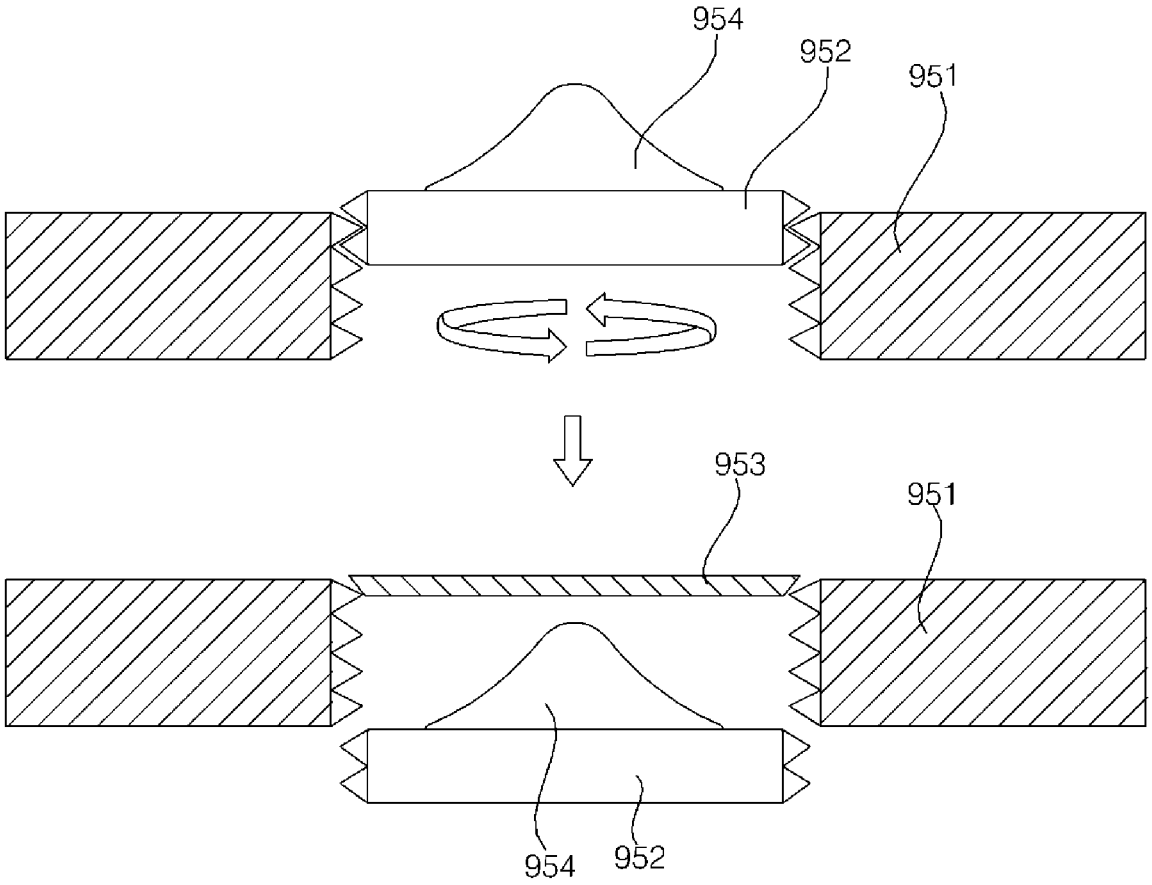
FIG. 12 is a view of how the position of the power contact unit differs depending on whether or not there is a module installed on the bathroom management apparatus according to the first exemplary embodiment of the present disclosure.

FIG. 5 is a view of lighting equipment installed on the bathroom management apparatus according to the first exemplary embodiment of the present disclosure. Referring to FIGS. 2 and 5, the lighting equipment 510, 520, 530, and 540 may be installed on at least one side within the cabinet 100. The lighting equipment 510, 520, 530, and 540 generates light and illuminates the bathroom through the gaps between the cabinet 100 and the door 300. The light generated by the lighting equipment 510, 520, 530, and 540 may illuminate the bathroom through the gaps between the cabinet 100 and the door 300. In one example, the lighting equipment 510, 520, 530, may provide relatively dimly illumination through the gaps. The lighting equipment 510, 520, 530, and 540 may include a light source for generating light and a case in which the light source may be installed. For example, the light source may be implemented as a light-emitting diode (LED).

The lighting equipment 510, 520, 530, and 540 may include a first lighting device 510 installed on the inside of the top portion of the cabinet 100, a second lighting device 520 installed on the inside of the bottom portion of the cabinet 100, a third lighting device 530 installed on the inside of the left portion of the cabinet 100, and a fourth lighting device 540 installed on the inside of the right portion of the cabinet 100.

The first lighting device 510 may illuminate the bathroom through the gap between the top portion of the cabinet 100 and the top of the door 300, the second lighting device 520 may illuminate the bathroom through the gap between the bottom portion of the cabinet 100 and the bottom of the door 300. Similarly, the third lighting device 530 may illuminate the bathroom through the gap between the left portion of the cabinet 100 and the left of the door 300, and the fourth lighting device 540 may illuminate the bathroom through the gap between the right portion of the cabinet 100 and the right of the door 300.

Referring to FIGS. 2, 4, and 6 to 9, guide rails 910 may be installed on a top surface of the first dividing plate 410 and on a bottom surface of the second dividing plate 420, and guide units (or guide inserts) 920 may be installed on the door 300 to slide laterally along the guide rails 910 when the door 300 opens and closes and to guide the opening and closing of the door 300. Each guide unit 920 may include a roller 921 that rolls along the guide rail 910 when the door 300 opens and closes, and a support unit (or frame) 922 that is attached to the roller 921 and the backside of the door 300 and rotatably supports the roller 921.

Two guide units 920 may be installed on the top of the backside of the first door 310, and another two guide units 920 may be installed on the bottom of the backside of the first door 310. Likewise, two more guide units 920 may be installed on the top of the backside of the second door 320, and still another two guide units 920 may be installed on the bottom of the backside of the second door 320.

Meanwhile, an outlet vane (or cover) 930 for opening and closing the air outlet 117 may be installed on the cabinet 100. The outlet vane 930 may be provided between the top portion of the cabinet 100 and the top of the door 300 to open and close the air outlet 117. An outlet vane motor 940 for driving the outlet vane 930 may be installed on the cabinet 100. The outlet vane 930 may extend or run laterally, and a length of the outlet vane 930 corresponds to the length of the air outlet 117. A rotating shaft 945 of the outlet vane motor 940 may be attached to one longitudinal end of the outlet vane 930 and rotate the outlet vane 930.

The outlet vane 930 may be shaped like it is bent once (e.g., initially extend in a first direction to an intermediate location and then extend in a different direction from the intermediate location), and its top end may be attached to the rotating shaft 945 of the outlet vane motor 940. The outlet vane 930 may open or close in one of three modes depending on the angle of rotation of the rotating shaft 945 of the outlet vane motor 940. That is, the outlet vane 930 may be in one of a closed mode for closing the air outlet 117, a first open mode for slightly opening the air outlet 117, or a second open mode for fully opening the air outlet 117.

When the blast fan 220 is not driven, the outlet vane 930 may be in the closed mode. For example, the part of the outlet vane 930 positioned in front of the air outlet 117 may be configured to slope downward towards the front when the blast fan 220 is driven, and the outlet vane 930 may open in the first open mode. Thus, when the outlet vane 930 opens in the first open mode, a flow of the air released from the air outlet 117 may hit the part of the outlet vane 930 positioned in front of the air outlet 117 and may be directed downwards in the bathroom. In this way, when the outlet vane 930 opens in the first open mode, the resulting redirected air flow may remove drops of moisture on the mirror 311 provided on the front of the door 300 and also helps dry excess water from a user's body after a shower.

When the blast fan 220 is driven and the outlet vane 930 opens in the second open mode (e.g., the fully opened mode), the air released from the air outlet 117 may be directed upwards in the bathroom. In this way, when the outlet vane 930 opens in the second open mode, it may be used to dry the bathroom.

Referring to FIGS. 2 and 10 to 12, a power contact unit 950 may be installed in a portion of cabinet 100 corresponding to where the module 700 is installed in the storage chambers S1 and S2. The power contact unit 950 may include a housing 951 and a contact plate 952 contained within the housing 951 in such a way as to be taken out of the housing 951.

The housing 951 may be formed in the shape of a relatively shallow cylinder with a hollow inside in which the contact plate 952 may be contained. Preferably, the housing 951 may be inserted into a hole formed in one side forming the storage chambers S1 and S2 of the cabinet 100 and may be provided in parallel with the one side forming the storage chambers S1 and S2 of the cabinet 100.

The contact plate 952 may be shaped like a disc, with a contact protrusion 954 formed on one side which comes into contact with a contact terminal 701 provided on the module 700. Preferably, the contact protrusion 954 may be formed on one side of the contact plate 952 in the direction in which it may be taken out of the housing 951. Since the electric power converted by the power supply 820 flows through the contact protrusion 954, the contact terminal 701 provided on the module 700 may come into contact with the contact protrusion 954 and receive electric power if the module 700 is installed in the storage chambers S1 and S2.

As previously described, one or more modules 700 may be selectively installed at the option of a user, and the module 700 may be omitted from one or more of the storage chambers S1 and S2. If the module 700 is not installed in the storage chambers S1 or S2, the contact protrusion 954 may not protrude from one side forming the storage chambers S1 and S2, in order to provide a desirable aesthetic appearance and to preserve space within the storage chambers S1 and S2 for storing towels or other bathroom items. Therefore, if the module 700 is not installed in the storage chambers S1 or S2, the contact plate 952 may be inserted into the housing 951. After the contact plate 952 is inserted into the housing 951, the open part of the housing 951 may be shielded by a cover 953. As the cover 953 shields the open part of the housing 951, the cover 953 may be provided in parallel with the one side forming the storage chambers S1 and S2.

In order to contain the contact plate 952 within the housing 951 and, if necessary, to take it out of the housing 951, teeth or other extensions may be formed on the inner periphery of the housing 951 and the outer periphery of the contact plate 952, and these teeth mesh with each other. Thus, the contact plate 952 may be taken out of the housing 951 by rotating it in one direction, or may be contained within the housing 951 by rotating it in the opposite direction.

Figure 13:
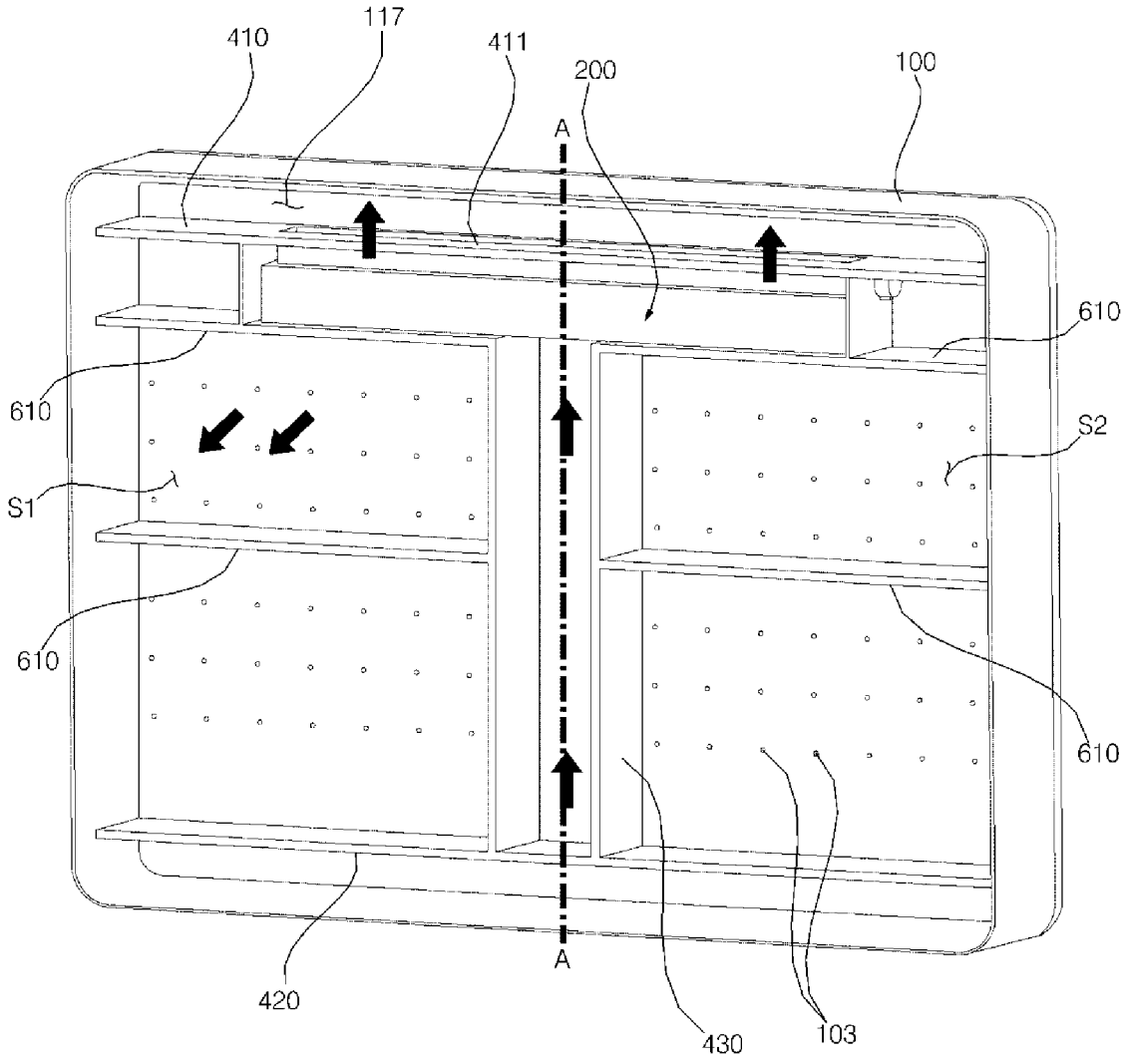
FIG. 13 is a view of a cabinet for a bathroom management apparatus according to a second exemplary embodiment of the present disclosure.
Figure 14:
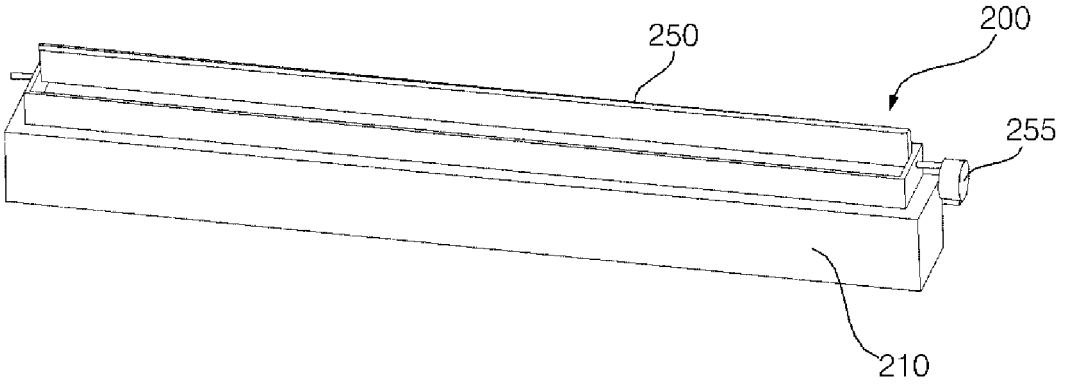
FIG. 14 is a view of the air conditioning unit of FIG. 13.
Figure 15:
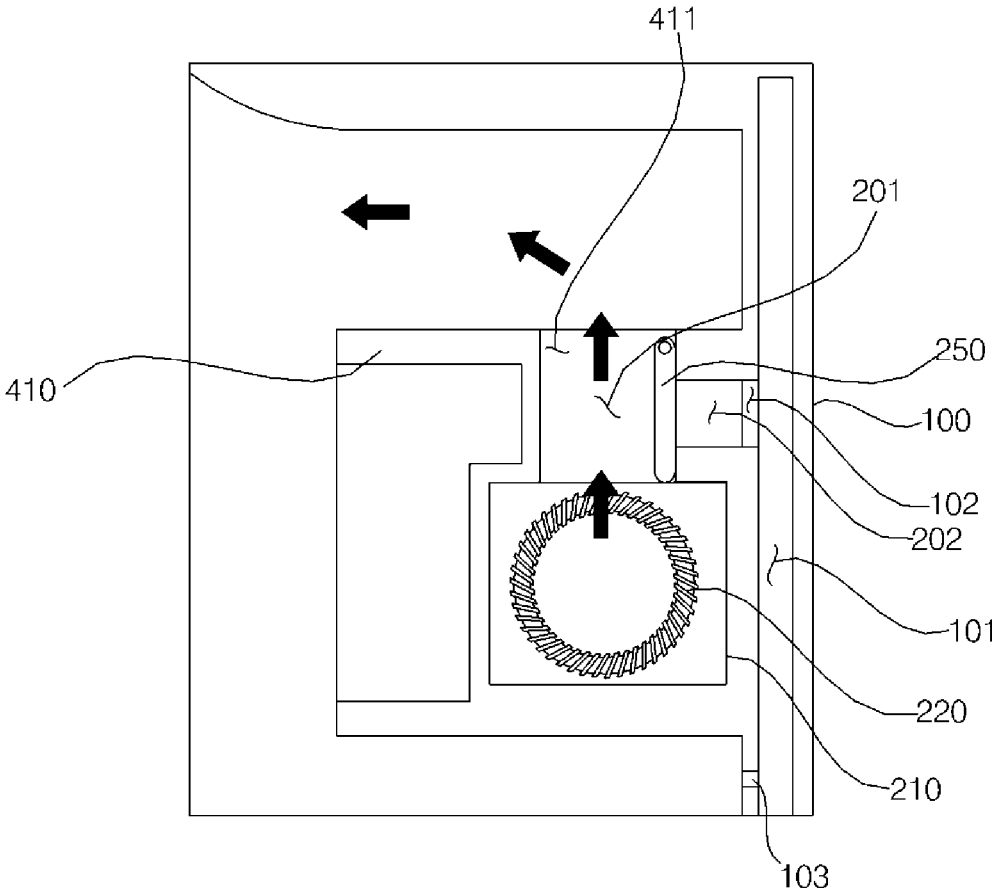
FIG. 15 is a cross-sectional view taken along the line A-A of FIG. 13, which shows that a flow path switching vane has switched the air flow in the air conditioning module to an air outlet.
Figure 16:
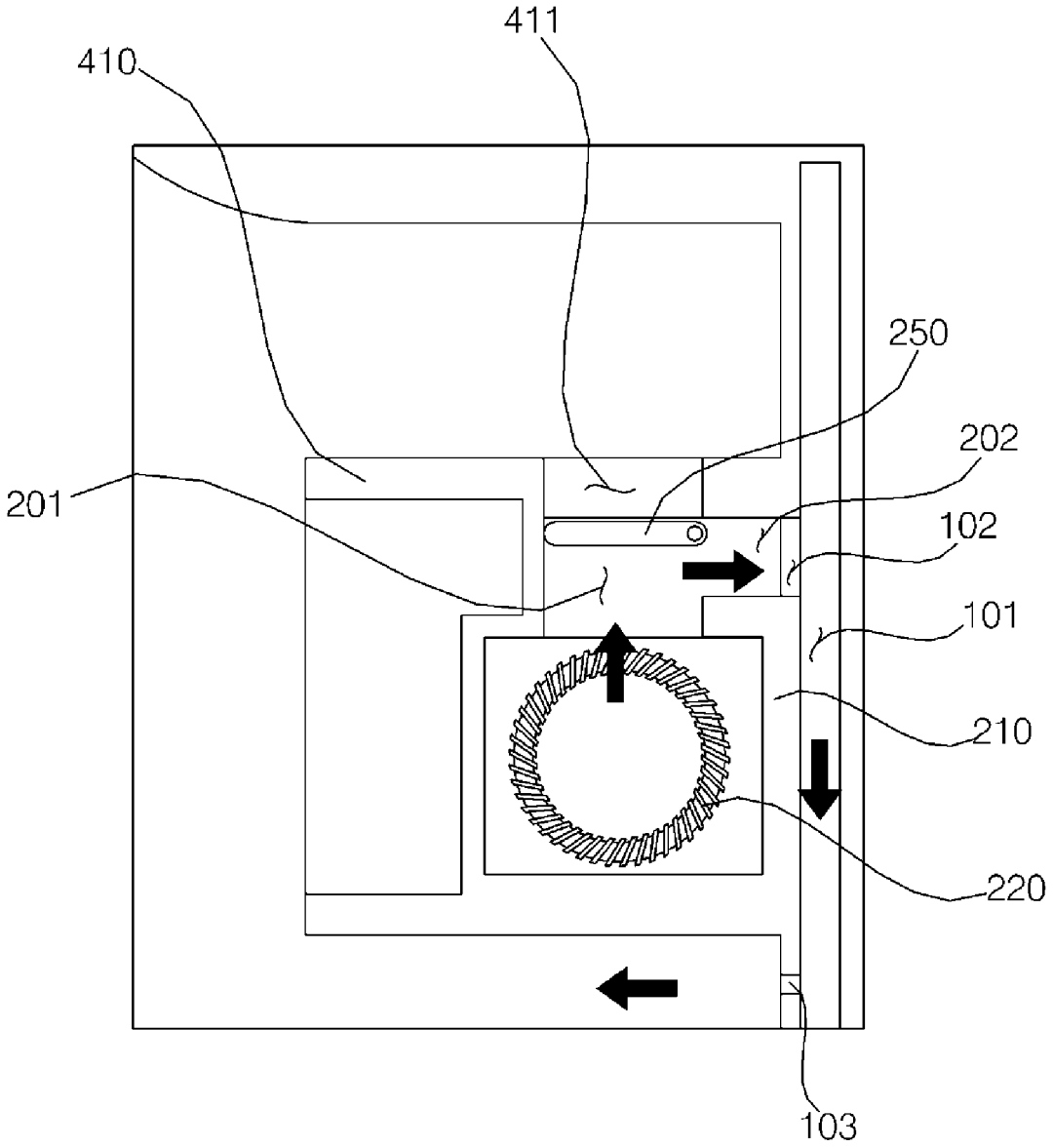
FIG. 16 is a cross-sectional view taken along the line A-A of FIG. 13, which shows that the flow path switching vane has switched the air flow in the air conditioning module to an inlet for dehumidification.

FIG. 13 is a view of a cabinet for a bathroom management apparatus according to a second exemplary embodiment of the present disclosure; FIG. 14 is a view of the air conditioning unit of FIG. 13; FIG. 15 is a cross-sectional view taken along the line A-A of FIG. 13, which shows that a flow path switching vane has switched the air flow in the air conditioning module to an air outlet; and FIG. 16 is a cross-sectional view taken along the line A-A of FIG. 13, which shows that the flow path switching vane has switched the air flow in the air conditioning module to an inlet for dehumidification. Here, the same parts as the foregoing first exemplary embodiment are denoted by the same reference numerals, so a detailed description thereof will be omitted and only the differences will be described.

Referring to FIGS. 13 to 16, it can be seen that the cabinet 100 for the bathroom management apparatus according to the second exemplary embodiment of the present disclosure may be different from that of the first exemplary embodiment shown in FIGS. 1-12. That is, in the foregoing first exemplary embodiment, the first storage chamber S1 and the second storage chamber S2 each may be divided into upper and lower sections by the horizontal dividing plate 610 and divided into left and right sections by the vertical dividing plate 620, whereas, in the second exemplary embodiment, the first storage chamber S1 and the second storage chamber S2 each may be only divided into upper and lower sections by the horizontal dividing plate 610. Optionally, in the second exemplary embodiment, the first storage chamber S1 and the second storage chamber S2 may be further divided into left and right sections by the vertical dividing plate 620, as in the first exemplary embodiment.

While one or more modules 700 may be installed in the storage chambers S1 and S2 in the foregoing first exemplary embodiment, the following discussion describes the module 700 as being omitted from the storage chambers S1 and S2 in this second exemplary embodiment. Alternatively, in some examples of this second exemplary embodiment, the module 700 may be installed in the storage chambers S1 and S2, similar to the manner described with respect as in the first exemplary embodiment.

In the rear portion of the cabinet 100, a slit 101 may be formed on the inside, an inlet 102 for dehumidification may be formed and may communicate with the air conditioning module 200 and the slit 101, and a vent 103 for dehumidification may be formed and may communicate with the storage chamber S1 and S2 and the slit 101.

The air conditioning module 200 may include a flow path switching vane 250 that switches a flow of conditioned (e.g., warmed and/or dried) air to either the air outlet 117 or the inlet 102 for dehumidification. The flow path switching vane 250 may be driven by a flow path switching vane motor 255. The flow path switching vane 250 may run laterally, and a rotating shaft of the flow path switching vane motor 255 may be attached to one longitudinal end of the flow path switching vane 250 and rotate the flow path switching vane 250.

In the case 210 of the air conditioning module 200, a first flow path 201 communicating with the first communicating hole 411 may be formed in the first dividing plate 410, and a second flow path 202 communicating with the inlet 102 for dehumidification may be formed. The flow path switching vane 250 may operate in a first mode for opening the first flow path 201 and closing the second flow path 202, as shown in FIG. 15, and may operate in a second mode for closing the first flow path 201 and closing the second flow path 202, as shown in FIG. 16.

When the flow path switching vane 250 opens the first flow path 201 and closes the second flow path 202, the air in the duct 430 may pass through the first flow path 201 and the first communicating hole 411 and may be then discharged into the bathroom through the air outlet 117. Also, when the flow path switching vane 250 closes the first flow path 201 and opens the second flow path 202, the air in the duct 430 may pass through the second flow path 202 and the inlet 102 for dehumidification (e.g., by being heated) and may then flow into the storage chambers S1 and/or S2 through the vent 103 to remove moisture from the storage chambers S1 and S2.

Meanwhile, the slit 101, the inlet 102 for dehumidification, and the vent 103 for dehumidification according to the second exemplary embodiment may be formed in the rear portion of the cabinet 100 of the first exemplary embodiment, and the flow path switching vane 250 according to the second exemplary embodiment of the present disclosure may be included in the air conditioning module 200 of the first exemplary embodiment.

Figure 17:
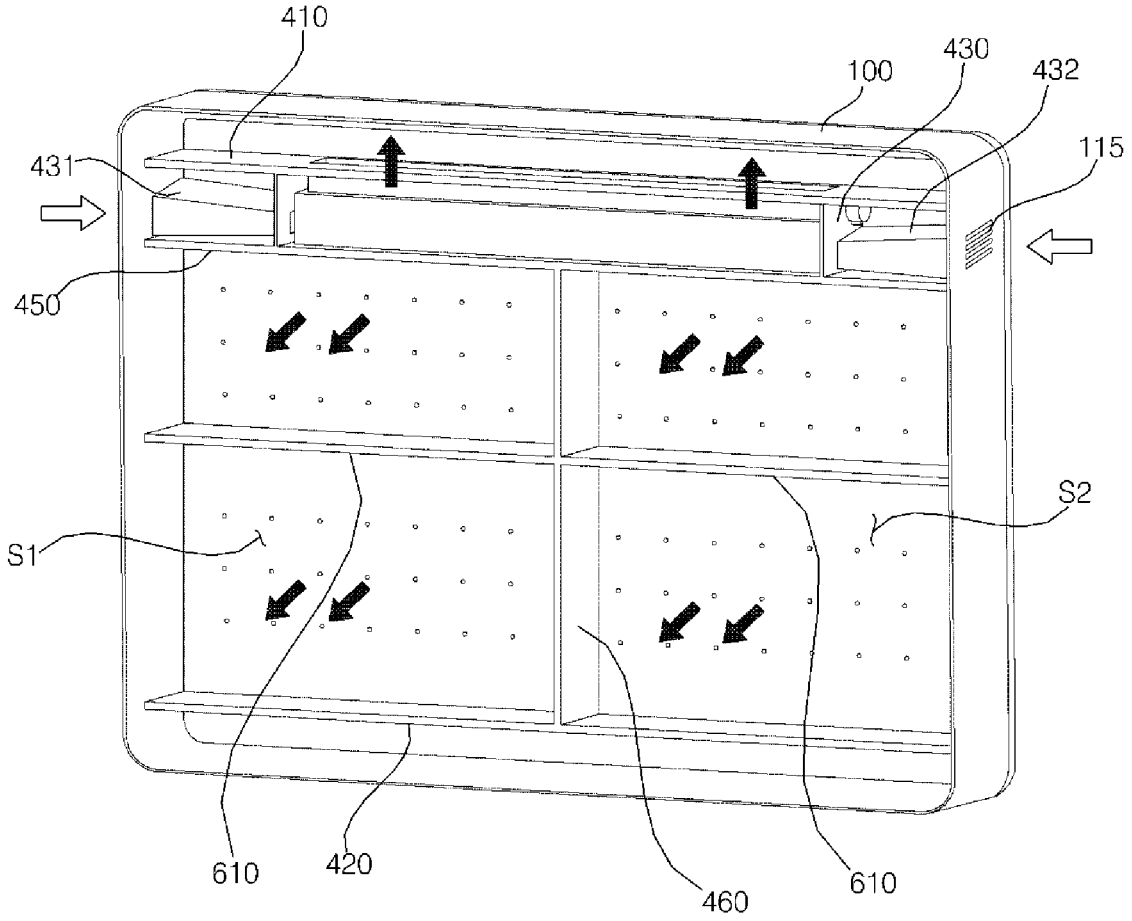
FIG. 17 is a view of a cabinet for a bathroom management apparatus according to a third exemplary embodiment of the present disclosure.

FIG. 17 is a view of a cabinet for a bathroom management apparatus according to a third exemplary embodiment of the present disclosure. Here, the same parts as the foregoing first exemplary embodiment shown in FIG. 1 are denoted by the same reference numerals, so a detailed description thereof will be omitted and only the differences will be described.

Referring to FIG. 17, it can be seen that the cabinet 100 for the bathroom management apparatus according to the third exemplary embodiment of the present disclosure may be different from that of the first exemplary embodiment. That is, in the foregoing first exemplary embodiment, the first dividing plate 410 and the second dividing plate 420 may be installed in the interior space of the cabinet 100, and the storage chamber S1 and S2 may be therefore formed between the first dividing plate 410 and the second dividing plate 420. In comparison, in the third exemplary embodiment, a third dividing plate 450 may be additionally installed in the interior space of the cabinet 100, and the storage chamber S1 and S2 may be formed between the second dividing plate 420 and the third dividing plate 450.

The third dividing plate 450 may be located immediately below the first dividing plate 410 and may be spaced apart from the first dividing plate 410. That is, the third dividing plate 450 may be provided closer to the first dividing plate 410 than to the second dividing plate 420. The third dividing plate 450 may run laterally, and may be provided in parallel with the first dividing plate 410 and the second dividing plate 420. For example, the left edge of the third dividing plate 450 may be attached to the left portion of the cabinet 100, and the right edge may be attached to the right portion of the cabinet 100.

Moreover, in the foregoing first exemplary embodiment, the storage chamber S1 and S2 may divided into left and right sections by the duct 430, whereas, in the third exemplary embodiment of FIG. 17, the storage chamber S1 and S2 may be divided into left and right sections by a fourth dividing plate 460. The fourth dividing plate 460 may be connected to the second dividing plate 420 and the third dividing plate 450 and may equally divide the storage chamber S1 and S2 into left and right sections. The fourth dividing plate 460 may be vertically provided at right angles to the second dividing plate 420 and the third dividing plate 450.

In addition, in the foregoing first exemplary embodiment, the first storage chamber S1 and the second storage chamber S2 each may be divided into upper and lower sections by the horizontal dividing plate 610 and also divided into left and right sections by the vertical dividing plate 620. In contrast, the third exemplary embodiment shown in FIG. 17 may include the first storage chamber S1 and the second storage chamber S2 that each may be only divided into upper and lower sections by the horizontal dividing plate 610.

Furthermore, in the foregoing first exemplary embodiment, the duct 430 may be connected to the first dividing plate 410 and the second dividing plate 420 and divides the storage chamber S1 and S2 into left and right sections, whereas, in the third exemplary embodiment of FIG. 17, the duct 430 may connect the first dividing plate 410 and the third dividing plate 450 and may be provided above the storage chamber S1 and S2. Furthermore, the left edge of the duct 430 may be tucked away or covered to the right of the left portion of the cabinet 100, and the right edge of the duct 430 may be tucked away or covered to the left of the right portion of the cabinet 430.

Furthermore, in the foregoing first exemplary embodiment, the air inlet 115 may be formed in the bottom portion of the cabinet 100, whereas, in the third exemplary embodiment of FIG. 17, the air inlet 115 may be formed in the left and right portions of the cabinet 100, and more specifically, between the first dividing plate 410 and the third dividing plate 450. The left edge of the duct 430 may be connected to the left portion of the cabinet 100 through a first inlet guide 431 and may communicate with the air inlet 115, and the right edge of the duct 430 may be connected to the right portion of the cabinet 100 and may communicate with the air inlet 115.

With a bathroom management apparatus thus configured according to an exemplary embodiment of the present disclosure, towels and other bathroom items can be stored in the storage chamber S1 and S2, mold and bacteria growth in a bathroom can be prevented by drying the inside of the bathroom by air conditioned and dried by the air conditioning module 200, and the space utilization of the bathroom can be improved since a storage cabinet and the air conditioning module are integrated together. Moreover, with a bathroom management apparatus according to an exemplary embodiment of the present disclosure, greater storage space can be obtained because the duct 430 may be provided in a dead zone which cannot be used as a storage space.

With a bathroom management apparatus according to an exemplary embodiment of the present disclosure, various kinds of convenient modules including the sterilization module 710 and the refrigeration module 720 may be installed according to the user's selection.

With a bathroom management apparatus according to an exemplary embodiment of the present disclosure, the inside of the bathroom may be dried by heat generated from the heat transfer module 810 and power supply 820 installed within the duct 430.

With a bathroom management apparatus according to an exemplary embodiment of the present disclosure, the mirror 311 provided on the front of the door 300 can be used in place of a bathroom mirror. With a bathroom management apparatus according to an exemplary embodiment of the present disclosure, light generated by the lighting equipment 510, 520, 530, and 540 installed within the cabinet 100 may be used in place of other bathroom lighting.

With a bathroom management apparatus according to an exemplary embodiment of the present disclosure, the user's body can be dried, as well as the bathroom, since the direction of released air may be adjusted by adjusting the open angle of the outlet vane 930. Additionally, with a bathroom management apparatus according to an exemplary embodiment of the present disclosure, air conditioned and dried by the air conditioning module 200 may be released to the storage chamber S1 and S2, thereby dehumidifying towels and other bathroom items stored in the storage chamber S1 and S2.

A first aspect of the present disclosure is to provide a bathroom management apparatus which improves the space utilization of a bathroom by integrating a storage cabinet and an air conditioning module together. A second aspect of the present disclosure is to provide a bathroom management apparatus which can minimize the likelihood that components for sliding a first door and a second door are seen from the outside. A third aspect of the present disclosure is to provide a bathroom management apparatus which provides for a lot of storage space by installing a duct in a dead zone which cannot be used as a storage space. A fourth aspect of the present disclosure is to provide a bathroom management apparatus which can dehumidify bathroom items including towels stored in a storage chamber.

In order to accomplish the first aspect, the present disclosure provides a bathroom management apparatus including: a cabinet forming an interior space whose front is open; a first dividing plate provided within the cabinet and dividing the interior space; a second dividing plate provided within the cabinet in parallel with the first dividing plate and dividing the interior space, and forming a storage chamber in the space between the first and second dividing plates; a duct connected to the first dividing plate and the second dividing plate, provided within the cabinet, and dividing the storage chamber; and an air conditioning module installed within the duct.

In order to accomplish the second aspect, the bathroom management apparatus according to the present disclosure is characterized in that the storage chamber includes: a first storage chamber provided on one side of the duct; and a second storage chamber provided on the other side of the duct, and the storage chamber further includes: a first door slidably installed on the first dividing plate and second dividing plate and opening and closing the first storage chamber; and a second door slidably installed on the first dividing plate and second dividing plate and opening and closing the second storage chamber In order to accomplish the third aspect, the bathroom management apparatus according to the present disclosure is characterized in that, when either the first door or the second door is fully open, the first door and the second door block the duct from the front. In order to accomplish the fourth aspect, the bathroom management apparatus according to the present disclosure is characterized in that, in the rear portion of the cabinet, a slit is formed on the inside, an inlet for dehumidification is formed and communicates with the air conditioning module and the slit, and a vent for dehumidification is formed and communicates with the storage chamber and the slit.

Related to the first aspect of the present disclosure, towels and other bathroom items may be stored in a storage chamber, mold and bacteria growth in a bathroom can be prevented by drying the inside of the bathroom by air conditioned by an air conditioning module, and the space utilization of the bathroom can be improved since a storage cabinet and the air conditioning module may be integrated together.

Related to the second aspect of the present disclosure, since a first door and a second door are installed on a first dividing plate and a second dividing plate and components for sliding the first door and the second door may be blocked by the cabinet, it may be possible to minimize the likelihood that the components for sliding the first door and the second door are seen from the outside.

Related to the third aspect of the present disclosure, increased storage space may be obtained because a duct is provided in a dead zone which cannot be used as a storage space. Related to the fourth aspect of the present disclosure, air conditioned and dried by the air conditioning module may moves into a slit through an inlet for dehumidification and may then be released to the storage chamber through a vent for dehumidification. Accordingly, bathroom items including towels stored in the storage chamber may be dehumidified by air released through the vent for dehumidification.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A bathroom management apparatus comprising:

a cabinet forming an interior space with an open front;

a first dividing plate provided within the cabinet to divide the interior space;

a second dividing plate provided within the cabinet in parallel with the first dividing plate to further divide the interior space, at least one storage chamber being formed in the interior space between the first and second dividing plates;

a duct provided within the cabinet and connected to the first dividing plate and the second dividing plate to divide the at least one storage chamber; and a dryer installed within the duct, wherein the at least one storage chamber includes:

a first storage chamber provided on a first side of the duct; and a second storage chamber provided on a second side of the duct, and wherein the bathroom management apparatus further comprises:

a first door slidably installed on the first dividing plate and the second dividing plate to open or close the first storage chamber; and a second door slidably installed on the first dividing plate and the second dividing plate to open or close the second storage chamber.

2. The bathroom management apparatus of claim 1, wherein:

the cabinet is in the shape of a rectangle with a top surface, a bottom surface, and left and right surfaces, the first dividing plate is provided between the top surface and the second dividing plate and is connected to the left surface and right surface to divide the interior space into upper and lower first sections, and the second dividing plate is provided between the bottom surface and the first dividing plate and is connected to the left surface and right surface to divide the interior space into upper and lower second sections.

3. The bathroom management apparatus of claim 1, wherein an air inlet to provide a first air flow path into the duct is formed in a bottom surface of the cabinet, and an air outlet to provide a second air flow path out of the duct is formed in between a top surface of the cabinet and the first dividing plate.

4. The bathroom management apparatus of claim 3, wherein a first communicating hole is formed in the first dividing plate to communicate within the air outlet and the duct, and a second communicating hole is formed in the second dividing plate to communicate within the air inlet and the duct.

5. The bathroom management apparatus of claim 4, further comprising a shield plate that is connected to the bottom surface of the cabinet and the second dividing plate and is provided closer to the front than the air inlet and the second communicating hole, the shield plate covering a space between the bottom surface of the cabinet and the second dividing plate.

6. The bathroom management apparatus of claim 1, wherein the duct includes an open rear, and the open rear of the duct is covered by a rear surface of the cabinet.

7. The bathroom management apparatus of claim 1, wherein, when either the first door or the second door is fully open, the fully opened one of the first door or the second door blocks a front of the duct.

8. The bathroom management apparatus of claim 1, further comprising at least one sterilizer installed in the at least one storage chamber.

9. The bathroom management apparatus of claim 1, further comprising at least one refrigerator installed in the at least one storage chamber.

10. The bathroom management apparatus of claim 9, further comprising a heat transfer installed within the duct to feed cooled air into the at least one refrigerator and warmed air to an outside of the at least one refrigerator.

11. The bathroom management apparatus of claim 1, further comprising a power supply installed within the duct to convert electric power.

12. The bathroom management apparatus of claim 1, further comprising:

guide rails installed on the first dividing plate and the second dividing plate; and guide inserts installed on the first door and the second door to slide along the guide rails when the first door and the second door open and close.

13. The bathroom management apparatus of claim 1, wherein the first door and the second door are placed within an edge of the open front of the cabinet and are spaced a distance apart from the edge to form a gap between the first and second doors and the cabinet.

14. The bathroom management apparatus of claim 13, further comprising lighting that is installed within the cabinet to output light to illuminate the bathroom through the gap between the cabinet and the first and second doors.

15. The bathroom management apparatus of claim 14, wherein the lighting includes:

a first lighting device installed on an upper region inside the cabinet;

a second lighting device installed on a bottom region inside the cabinet;

a third lighting device installed on a left region inside the cabinet; and a fourth lighting device installed on a right region inside the cabinet.

16. A bathroom management apparatus comprising:

a cabinet forming an interior space with an open front;

a first dividing plate provided within the cabinet to divide the interior space;

a second dividing plate provided within the cabinet in parallel with the first dividing plate to further divide the interior space, a storage chamber being formed in the interior space between the first and second dividing plates;

a duct provided within the cabinet and connected to the first dividing plate and the second dividing plate to divide the storage chamber;

a dryer installed within the duct;

an air outlet to provide an air flow path out of the duct;

an outlet vane provided over the air outlet; and a motor to drive a movement of the outlet vane to selectively open or close the air outlet, wherein an air inlet to provide a first air flow path into the duct is formed in a bottom surface of the cabinet, and an air outlet to provide a second air flow path out of the duct is formed in between a top surface of the cabinet and the first dividing plate.

17. The bathroom management apparatus of claim 1, wherein the dryer includes:

a case;

a heater installed within the case, and a blast fan installed within the case to provide air flow by the heater.

18. A bathroom management apparatus of claim 1, further comprising:

a cabinet forming an interior space with an open front;

a first dividing plate provided within the cabinet to divide the interior space;

a second dividing plate provided within the cabinet in parallel with the first dividing plate to further divide the interior space, a storage chamber being formed in the interior space between the first and second dividing plates;

a duct provided within the cabinet and connected to the first dividing plate and the second dividing plate to divide the storage chamber;

a dryer installed within the duct;

a slit on a rear surface of the cabinet;

an inlet that provides air communication between the dryer and the slit; and a vent that provides air communications between the storage chamber and the slit, wherein the dryer further includes flow path switching vane that is moved to selectively direct a flow of conditioned air from the dryer to either an outlet of the duct or an inlet of the duct.

19. The bathroom management apparatus of claim 18, further comprising at least one of a sterilizer or a refrigerator installed in the at least one storage chamber.

20. The bathroom management apparatus of claim 18, further comprising:

a first door slidably installed on the first dividing plate and second dividing plate;

a second door slidably installed on the first dividing plate and second dividing plate, guide rails installed on the first dividing plate and the second dividing plate; and guide inserts installed on the first door and the second door to slide along the guide rails when the first door and the second door open and close.

* * * * *